US007875998B2

(12) United States Patent
Ting

(10) Patent No.: US 7,875,998 B2
(45) Date of Patent: Jan. 25, 2011

(54) POWER SUPPLY CONTROL CIRCUIT OF DISPLAY DEVICE

(75) Inventor: Yuan-Ko Ting, Taipei (TW)

(73) Assignee: Amtran Technology Co., Ltd, Chung Ho (TW)

( * ) Notice: Subject to any disclaimer, the term of this patent is extended or adjusted under 35 U.S.C. 154(b) by 1289 days.

(21) Appl. No.: 11/383,554

(22) Filed: May 16, 2006

(65) Prior Publication Data

US 2007/0109289 A1 May 17, 2007

(30) Foreign Application Priority Data

Nov. 16, 2005 (TW) ..... 94140294 A

(51) Int. Cl.
*H04N 5/63* (2006.01)
*H02B 1/24* (2006.01)

(52) U.S. Cl. ..... 307/140; 307/113; 307/130; 345/212; 348/730

(58) Field of Classification Search ..... 345/211, 345/212; 348/730; 307/113, 125, 130, 139, 307/140
See application file for complete search history.

(56) References Cited

U.S. PATENT DOCUMENTS 4,398,098 A * 8/1983 Minchey ..... 307/140
5,659,371 A * 8/1997 Krause ..... 348/730
5,748,263 A * 5/1998 Ball ..... 348/734
5,903,260 A * 5/1999 Imamura ..... 345/211
6,373,479 B1 * 4/2002 Moon ..... 345/211
7,015,904 B2 * 3/2006 Kim ..... 345/212
2004/0090436 A1 5/2004 Kushima

FOREIGN PATENT DOCUMENTS

| | | |
|---|---|---|
| CN | 1177883 | 4/1998 |
| CN | 86103181 A | 6/2008 |
| JP | 2000-181430 | 6/2000 |
| JP | 2004-163455 | 6/2004 |
| TW | 561334 | 11/2003 |
| TW | 2005101261531 | 3/2008 |

* cited by examiner

*Primary Examiner*—Gary L Laxton
(74) *Attorney, Agent, or Firm*—Workman Nydegger

(57) ABSTRACT

A power control circuit includes an isolation circuit for receiving a separate image signal and outputting a start signal, and a driving circuit for outputting a direct current (DC) power to start a power module. The other power control circuit includes a first signal generating circuit, for generating a first signal; a second signal generating circuit, for receiving a DC power and outputting a second signal upon receiving a first signal; a driving circuit, for outputting a DC power to start a power module after receiving the second signal; an isolation circuit, for receiving the separate image signal and outputting a start signal; and a control circuit, for outputting a DC power to start the power module after receiving the start signal. The operation of the power control circuit can be suspended, when the display device is in a standby state, thereby reducing power consumption in the standby state significantly.

22 Claims, 4 Drawing Sheets

POWER SUPPLY CONTROL CIRCUIT OF DISPLAY DEVICE

CROSS-REFERENCE TO RELATED APPLICATIONS

This Non-provisional application claims priority under 35 U.S.C. §119(a) on Patent Application No(s). 094140294 filed in Taiwan on Nov. 16, 2005, the entire contents of which are hereby incorporated by reference.

BACKGROUND OF THE INVENTION

1. Field of Invention

The present invention relates to a power control circuit, and more particularly to a power control circuit applied to a display device for reducing power consumption.

2. Related Art

A new energy code has been executed in the European Communities, in which the no load power consumption of a power supply must be lower than some restriction, and the restriction has become stricter. Besides, in the United States, President George W. Bush has subscribed an executive order, stating that all federal government units must purchase electronic/electrical appliances consuming less than 1 W of power in the standby state.

For conventional power control circuits, if a mechanical switch is not employed as the basic element, generally, the function of peripheral circuits is controlled for sustaining the operation of the system IC, thereby achieving power on and off. Therefore, at least a basic power is required for operation of the IC system. Even if a device is powered off by the switch, in fact the device is still in operation. As a result, power consumption cannot be reduced.

For example, Taiwan Patent No. 561334 discloses a Power Management System of a liquid crystal display (LCD), wherein an LCD device enters a normal mode or a power-saving mode respectively according to the enabling state or the disabling state of a synchronous signal. The disclosed power management system includes a power supply device, an electric power input switch device and a detection device. The power supply device converts a line voltage of an electric power source to supply it to the aforementioned display device. When the electric power input switch device is on, the line voltage is supplied to the power supply device, while when the electric power input switch device is off, the line voltage stops being supplied to the power supply device. The detection device is used to detect the synchronous signal switched from an enabling state into a disabling state, and then turn off the above-mentioned electric power input switch device after a predetermined time period.

To reduce power consumption, a method adopts, for example, a trigger mode in the standby state, in order to meet the regulation issued by the International Energy Agency (EA), i.e., the power consumption in the standby state should be lower than 1 W. The standard regulation prescribes the amount of standby power consumed by the switch mode power supply (SMPS) when the system is in a standby state.

As energy standards become stricter, the standby power consumption is required to be lower than 1 W, which is not easy for the power consumption of present electronic parts and devices. However, in order to meet the stricter power-saving standards, it has become a desired technical demand to reduce the power consumption of electronic devices in the standby state.

SUMMARY OF THE INVENTION

In view of the above, the invention discloses a power control circuit of a display device to solve the problems or shortcomings existing in the prior art.

One embodiment of the power control circuit disclosed in the invention includes an isolation circuit for receiving a separate image signal and outputting a start signal, and a driving circuit connected to the isolation circuit, for outputting a direct current (DC) power to start a power module after receiving the start signal.

Another embodiment of the power control circuit disclosed in the invention includes a first signal generating circuit, for outputting a first signal; a second signal generating circuit, connected to the first signal generating circuit, for outputting a second signal after receiving the first signal, wherein the second signal controls the on and off of the power module; a driving circuit, connected to the second signal generating circuit, for outputting a DC power to start a power module after receiving the second signal; an isolation circuit, for receiving the separate image signal and outputting a start signal; and a control circuit, connected to the isolation circuit, for outputting the DC power to start the power module after receiving the start signal.

According to the embodiments of the invention, the IC system does not need to have the function of turning on and off the machine, so it is unnecessary to supply electric power, the power control circuit can be suspended completely, thereby reducing consumption of the basic electric power. Through the operation of the separate image signal or the signal generating circuit, the display device can be restarted upon starting the power controller, and in the standby state, for the machine, only the operation of the second signal generating circuit need to be maintained, thereby significantly reducing power consumption.

The detailed features and advantages will be illustrated in detail in the following embodiments, and the technology of the invention will be apparent to those skilled in the art from the content, and those skilled in the related art can implement it accordingly. Moreover, anybody skilled in the related art can easily understand the relative objects and advantages of the invention according to the disclosure, claims, and drawings of the invention.

The above illustration of the disclosure of the invention and the following illustration of the embodiments are intended to demonstrate and explain the principles of the invention as well as to provide further explanations for the claims of the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and which thus is not limitative of the present invention, and wherein.

DETAILED DESCRIPTION OF THE INVENTION

To make a further understanding of the object, construction, characteristics and functions of the invention, a detailed description with reference to the embodiments is as follows.

Figure 1:
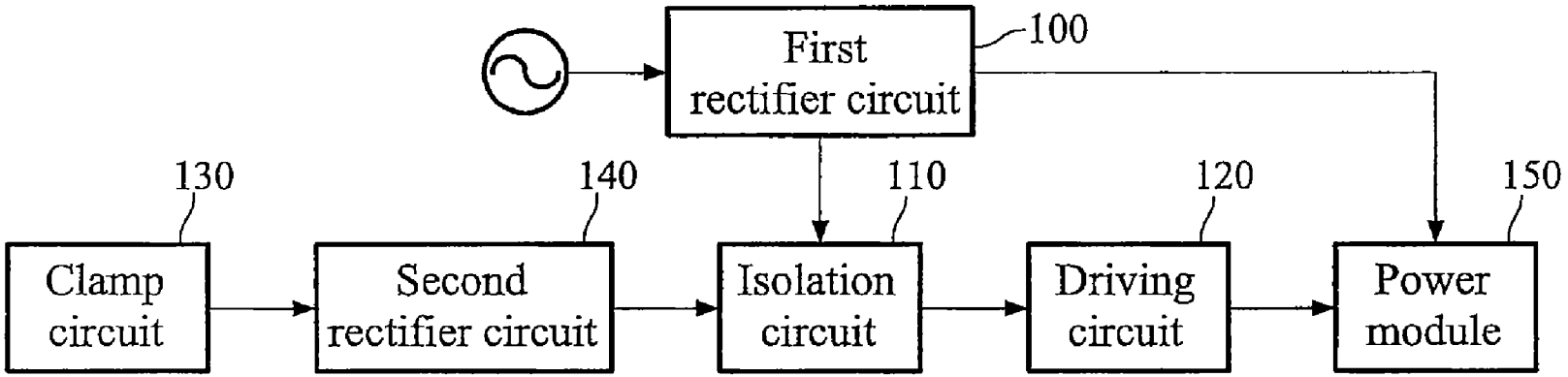
FIG. 1 is a system block view of the power control circuit according to the first embodiment of the invention.

Referring to FIG. 1, it is a system block view of the power control circuit according to the invention. The power control circuit includes a first rectifier circuit 100, an isolation circuit 110, a driving circuit 120, a clamp circuit 130, and a second rectifier circuit 140, for controlling the on-and-off of the power module 150. The component and function of the power control circuit are illustrated as follows.

The first rectifier circuit 100 is used to receive an alternating current (AC) power and rectify the AC power into a DC power. The isolation circuit 110 is used to separate the primary-side separate image signal and the secondary-side DC power when the display device is in a standby state. As the ground system of the separate image signal is different from that of the power control circuit, the isolation circuit 110 is disposed to avoid the interference between signals. When the display device returns to the normal mode, the isolation circuit 110 receives a separate image signal to output a start signal for starting the driving circuit 120. The driving circuit 120 transmits the DC power output by the first rectifier circuit 100 to the power module 150 after the isolation circuit 110 outputs the start signal.

In one embodiment, the separate image signal is a horizontal sync (H-SYNC), while in another embodiment the separate image signal is a vertical sync (V-SYNC). The separate image signal herein is used to enable the isolation circuit 110 in a standby or sleep mode to output a start signal for starting the driving circuit 120. In other embodiments, the isolation circuit 110 receives enabling signals capable of enabling the isolation circuit 110 to output a start signal for starting the driving circuit 120.

In one embodiment, in order to make the separate image signal effectively received by the isolation circuit 110 so as to start the power module 150 properly, a clamp circuit 130 and a second rectifier circuit 140 are adopted. The clamp circuit 130 clamps the separate image signal at a predetermined voltage level and the second rectifier circuit 140 is connected to the clamp circuit 130 for rectifying the separate image signal clamped at a predetermined voltage level. The clamp circuit 130 and the second rectifier circuit 140 are not necessary and can be adopted as desired.

In practice, the power module 150 can be a power supply. In another embodiment, it can be a pulse width modulation (PWM) power controller. In yet another embodiment, it can be a power control chip. The power module 150 can transmit the received DC power output by the first rectifier circuit 100 to the display device, to provide power for the system to operate properly.

According to the above-mentioned circuit structure, in a normal power supply state, the power required by the system can be rectified by the first rectifier circuit 100 and then supplied to the system by the power module 150. When the system enters the standby state, the display device suspends the input of the separate image signal functioning as the enabling signal, to make the whole system in a standby mode. At this time, the DC power output by the first rectifier circuit 100 stops being supplied to the power module 150. Till the isolation circuit 110 is enabled after receiving a separating image signal again, the isolation circuit 110 outputs a start signal to turn on the driving circuit 120, making the power module 150 restarted by the driving circuit 120. Through the above circuit structure, the power consumption of the display device in the standby state can be reduced, and thereby the power consumption of the whole system in the standby state is reduced.

Figure 2:
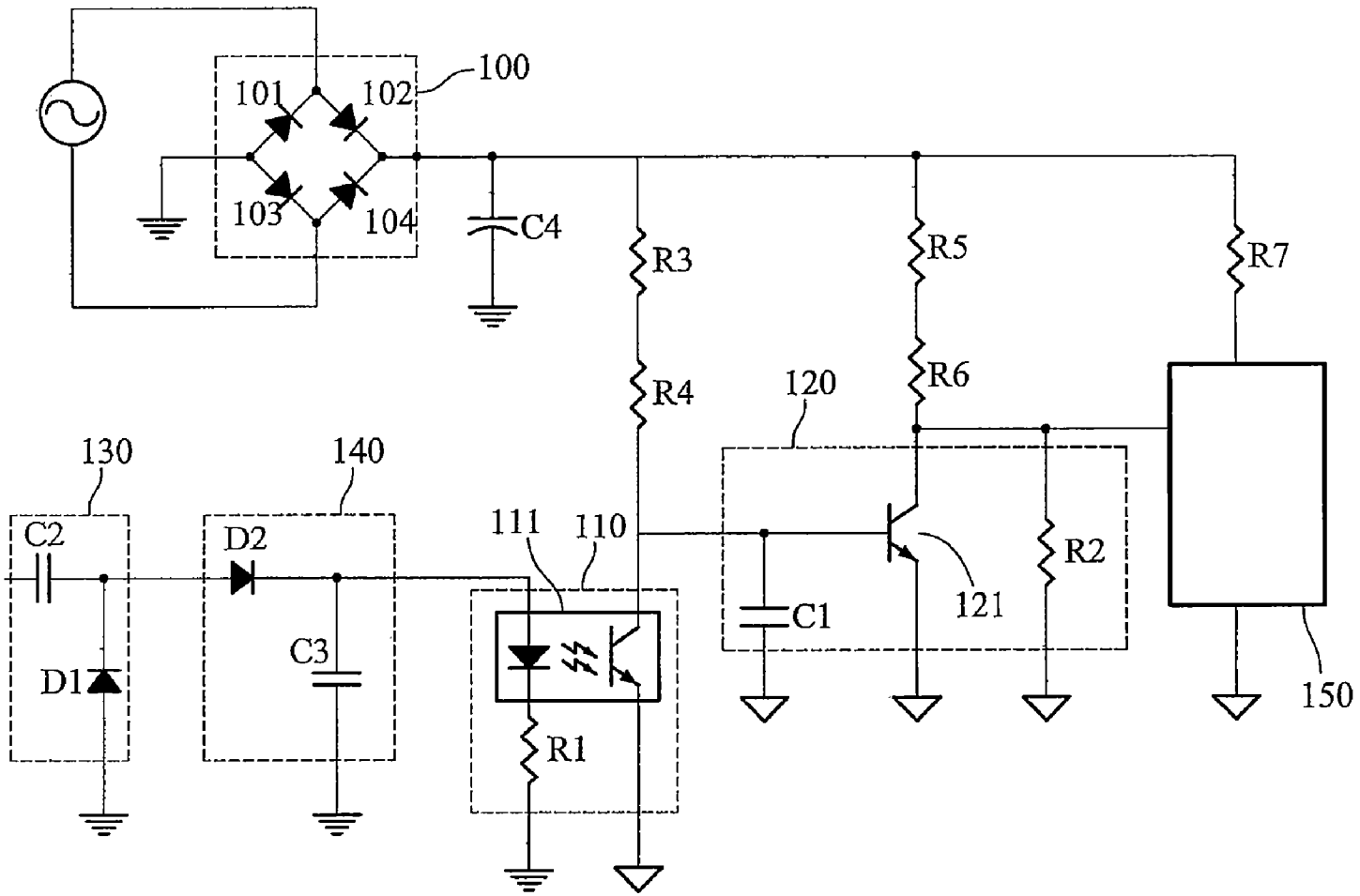
FIG. 2 is a detailed circuit diagram of the power control circuit according to the first embodiment of the invention.

Referring to FIG. 2, it is a detailed circuit diagram of the power control circuit according to the invention.

In one embodiment, the first rectifier circuit 100 is a full-wave bridge rectifier circuit including four diodes 101, 102, 103, and 104, for rectifying an AC power into a DC power. In another embodiment (not shown), a half-wave rectifier circuit can be adopted according to the actual demands of operating the circuit.

The isolation circuit 110, for example, includes an optical coupler 111 and a first resistor R1. The first resistor R1 is connected between the primary side of the optical coupler 111 and the ground end. The output end of the optical coupler 111 outputs a start signal upon receiving a separating image signal.

The driving circuit 120 receives the start signal output by the isolation circuit 110 and then transmits the DC power output by the first rectifier circuit 100 to the power module 150. The driving circuit 120 includes a transistor 121, which is an NPN-type bipolar transistor. In another embodiment, a PNP-type bipolar transistor can be adopted. In yet another embodiment, a metal oxide semiconductor field effect transistor (MOSFET), insulated gate bipolar transistor (IGBT) etc. can also be adopted. The input end (base end) of the transistor 121 is connected to the isolation circuit 110, and a first capacitor C1 is connected between the input end and the ground end. A second resistor R2 is connected between the output end (collector end) of the transistor 121 and the ground end. The emitter end of the transistor 121 is connected to the ground end.

The clamp circuit 130 clamps the separate image signal at a predetermined voltage level, and includes a second capacitor C2 and a first diode D1. The second rectifier circuit 140 is connected to the clamp circuit 130, and includes a third capacitor C3 and a second diode D2. The P-type side of the first diode D1 is connected to the ground, and the N-type side is connected to one end of the second capacitor C2. The P-type side of the second diode D2 is connected between the second capacitor C2 and the first diode D1, and the N-type side is connected to one end of the second capacitor C2.

Besides, in order to protect the whole circuit, the output end of the first rectifier circuit 100 is connected to a fourth capacitor C4, for filtering noise. Moreover, the output end of the first rectifier circuit 100 is connected to a third resistor R3 and a fourth resistor R4. The third resistor R3 and the fourth resistor R4 are connected to each other in series. In another embodiment, the third resistor R3 and the fourth resistor R4 are replaced by a single resistor after proper selection. A fifth resistor R5 and a sixth resistor R6 are connected between the output end of the first rectifier circuit 100 and the driving circuit 120. In another embodiment, the fifth resistor R5 and the sixth resistor R6 are replaced by a single resistor after proper selection. Besides, a seventh resistor R7 is connected between the output end of the first rectifier circuit 100 and the power module 150.

Figure 3:
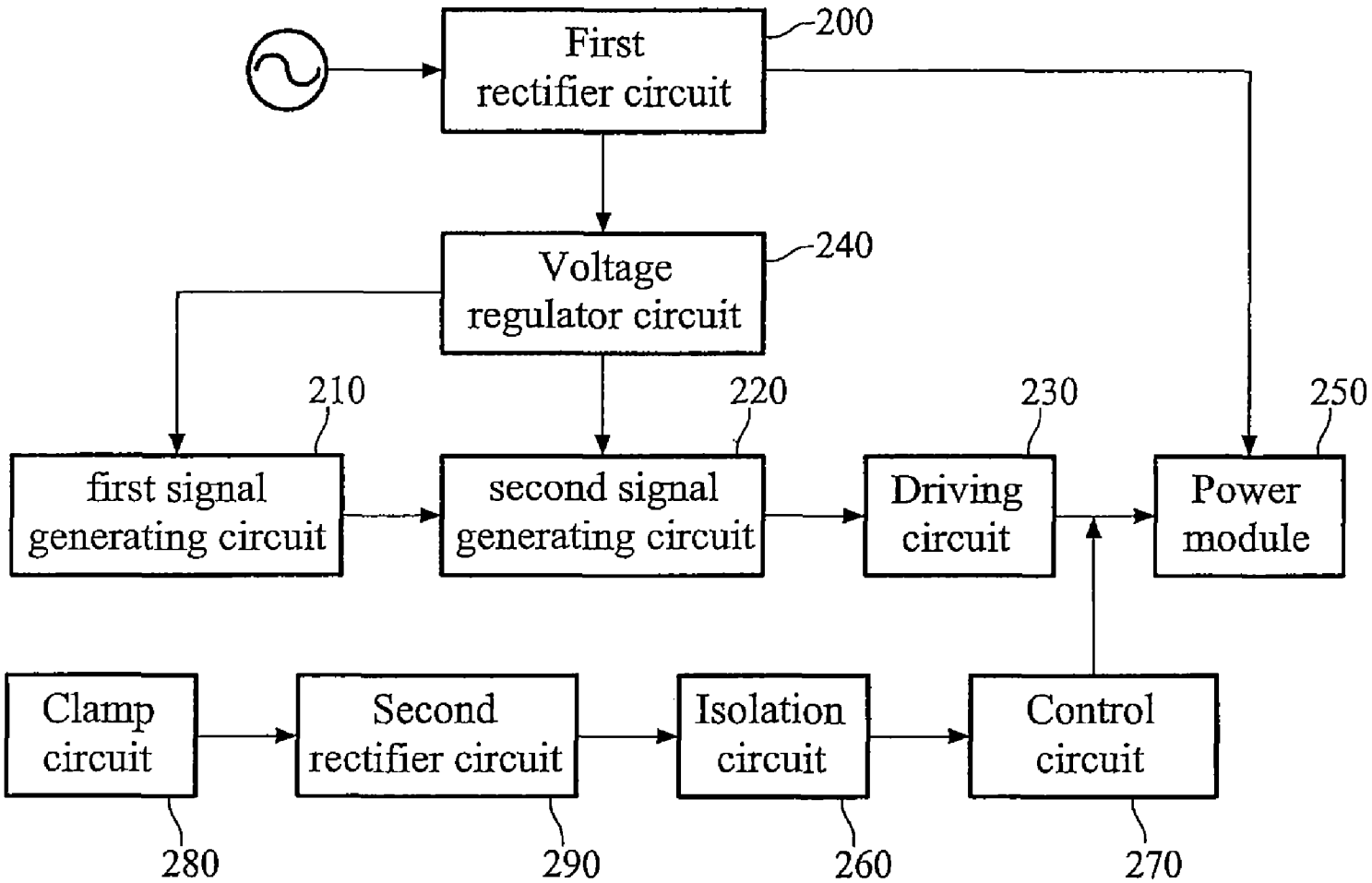
FIG. 3 is a system block view of the power control circuit according to the second embodiment of the invention.

Referring to FIG. 3, it is the second embodiment of the power control circuit according to the invention. In the embodiment, in the standby state, the power module can be started by the separate image signal, or by a trigger signal generated by the signal generating circuit.

According to the figure, the power control circuit includes a first rectifier circuit 200, a first signal generating circuit 210, a second signal generating circuit 220, a driving circuit 230, a voltage regulator circuit 240, an isolation circuit 260, a control circuit 270, a clamp circuit 280, and a second rectifier circuit 290, for controlling the on and off of the power module 250. The component and function of the power control circuit are illustrated as follows.

The first rectifier circuit 200 is used to receive an AC power, and rectify the AC power into a DC power. The first signal generating circuit 210 is used to generate a pulse signal to the second signal generating circuit 220. The second signal generating circuit 220 receives the DC power output by the first rectifier circuit 200 and the pulse signal output by the first signal generating circuit 210, and then outputs a start signal to start the driving circuit 230. The driving circuit 230, after the first signal generating circuit 210 outputs the pulse signal and the second signal generating circuit 220 outputs the start signal, transmits the DC power output by the first rectifier circuit 200 to the power module 250. In one embodiment, in order to enable the second signal generating circuit 220 to figure out the accurate pulse signal, the voltage regulator circuit 240 can be used to stabilize the voltage of the pulse signal. The voltage regulator circuit 240 is not necessary and can be adopted as desired.

The isolation circuit 260 is used to separate the primary-side separate image signal and the secondary-side DC power when the display device is in the standby state. When the display device receives a separating image signal, the isolation circuit 260 is enabled by the separate image signal to output a start signal to start the control circuit 270. The control circuit 270 transmits the DC power output by the first rectifier circuit 200 to the power module 250 after the isolation circuit 260 outputs the start signal.

In one embodiment, the separate image signal can be an H-SYNC. In another embodiment, the separate image signal can be a V-SYNC. The separate image signal herein is used to enable the isolation circuit 260 in a standby or sleep mode to output a start signal for starting the driving circuit 230. In other embodiments, the isolation circuit 260 can also receive enabling signals capable of enabling the isolation circuit 260 to output a start signal for starting the driving circuit 230.

In one embodiment, in order to make the separate image signal be effectively received by the isolation circuit 260 to start the power module 250 properly, a clamp circuit 280 and a second rectifier circuit 290 can be adopted. The clamp circuit 280 clamps the separate image signal at a predetermined voltage level and the second rectifier circuit 290 is connected to the clamp circuit 280, for rectifying the separate image signal clamped at a predetermined voltage level. The clamp circuit 280 and the second rectifier circuit 290 are not necessary and can be selected as desired.

In one embodiment, in practice, the power module 250 can be a power supply. In another embodiment, it can be a PWM power controller. In yet another embodiment, it can be a power control chip. The power module 250 receives the DC power output by the first rectifier circuit 200 and transmits it to the display device, thereby providing a power supply for the system to operate properly.

According to the above-mentioned circuit structure, in the normal power supply state, the power required by the display device can be rectified by the first rectifier circuit 200 and then supplied to the system by the power module 250. When the display device enters the standby state, the DC power output by the first rectifier circuit 200 stops providing power for the power module 250 and just provides the power required by the second signal generating circuit 220 to operate. After the first signal generating circuit 210 generates a pulse signal to the second signal generating circuit 220, the second signal generating circuit 220 outputs a start signal to turn on the driving circuit 230, enabling the power module 250 to start the display device by the second signal generating circuit 220 via the driving circuit 230, so that, the power consumption of the electronic elements in the standby state can be reduced and the power consumption of the whole system in the standby state can be reduced.

On the other hand, after the system enters the standby state, the DC power output by the first rectifier circuit 200 stops supplying power to the power module 250 and the input of the separate image signal functioning as the enabling signal is suspended. The isolation circuit 260 outputs a start signal to the control circuit 270 upon receiving a separate image signal again, making the power module 250 return to the normal operating state via controlling the control circuit 270. As a result, the power consumption of the whole system in the standby state can be reduced by stopping supplying power to the power module 250.

Figure 4:
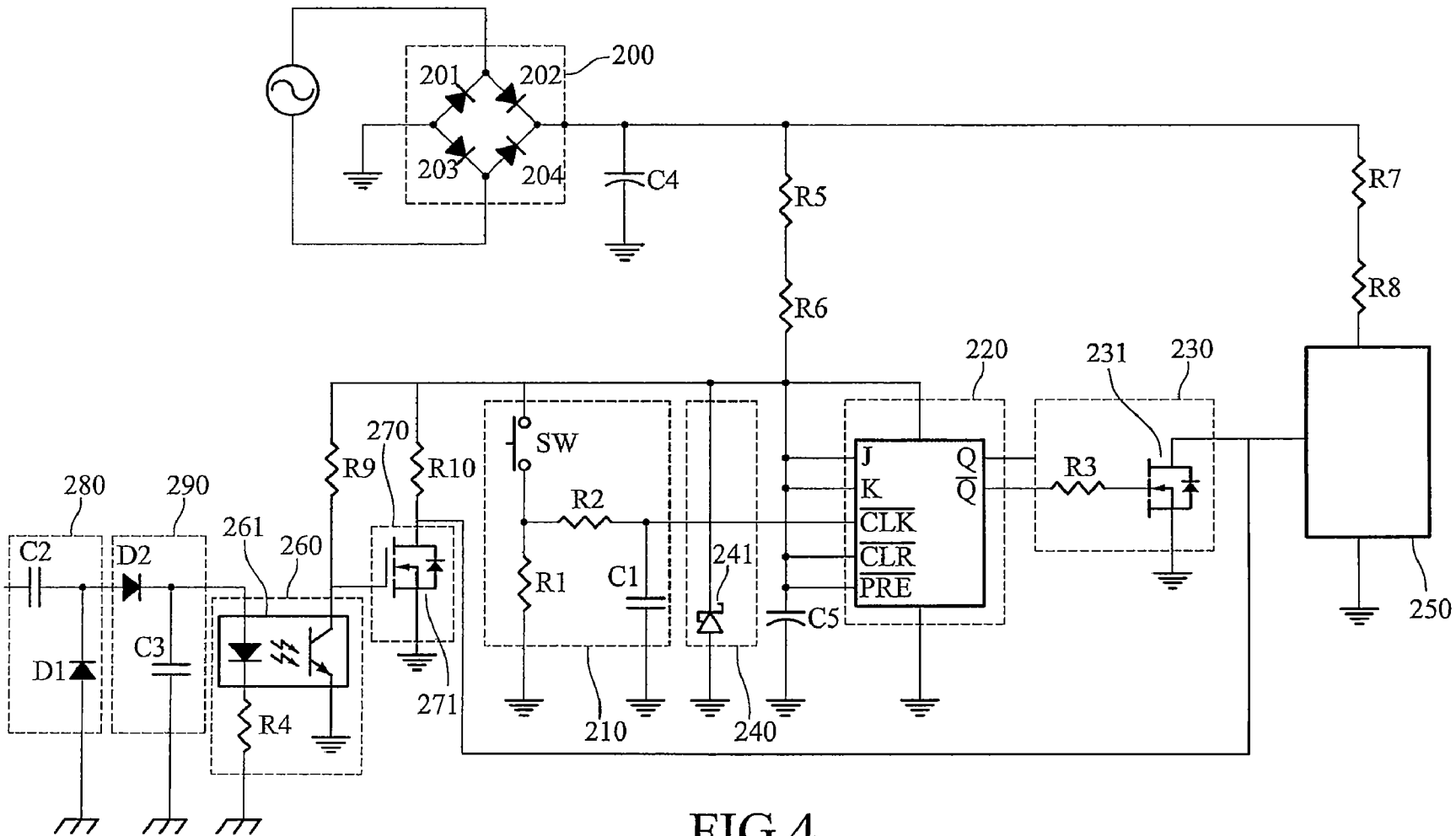
FIG. 4 is a detailed circuit diagram of the power control circuit according to the second embodiment of the invention.

Referring to FIG. 4, it is a detailed circuit diagram of the power control circuit according to the second embodiment of the invention.

In the second embodiment, the first rectifier circuit 200 is a full-wave bridge rectifier circuit including four diodes 201, 202, 203, and 204, for rectifying an AC power into a DC power. In another embodiment (not shown), a half-wave rectifier circuit can be adopted according to the actual demands of operating the circuit.

The first signal generating circuit 210 is used to generate a pulse signal to the second signal generating circuit 220 and includes a switch SW. One end of the switch SW is connected to the second signal generating circuit 220, while the other end of the switch SW is connected to the ground end through the first resistor R1. In another embodiment, considering that the stability and distinguishability of the first signal generating circuit 210 and the signals generated by the switch SW of the first signal generating circuit 210, the second resistor R2 and the first capacitor C1 can be added. One end of the second resistor R2 is connected to the first resistor R1, while the other end of the second resistor R2 is connected to the second signal generating circuit 220. One end of the first capacitor C1 is connected to the second resistor R2 while the other end of the first capacitor C1 is connected to the ground end.

The second signal generating circuit 220 receives the DC power output by the first rectifier circuit 200 and the pulse signal output by the first signal generating circuit 210, and then outputs a start signal. The start signal can be a high-level or a low-level voltage signal, for controlling the operation of the power module 250 according to different voltage levels. In one embodiment, a JK flip-flop is used, wherein the J input end and K input end are connected to the output end of the first signal generating circuit 210, i.e., connected to one end of the switch SW. The Q output end floats and the $\overline{Q}$ output end is electrically connected to the driving circuit 230. In another embodiment, the $\overline{Q}$ output end floats and the Q output end is electrically connected to the driving circuit 230. Furthermore, according to the aforementioned system block view, those of ordinary skill in the art should understand the Q output end or the $\overline{Q}$ output end can also be directly connected to the power module 250 to control the operation. The connecting method varies according to the characteristics of the power module 250.

The driving circuit 230 receives a start signal, and then transmits the DC power output by the first rectifier circuit 200 to the power module 250. The driving circuit 230 includes a transistor 231 which is an IGBT. In another embodiment, the MOSFET, bipolar transistor etc. can also be used. A third resistor R3 is connected between the $\overline{Q}$ output end and the transistor 231.

To enable the second signal generating circuit 220 to figure out the accurate pulse signals, the voltage regulator circuit 240 can be used to stabilize the voltage of the pulse signals. The voltage regulator circuit 240 includes a zener diode 241, wherein one end of the zener diode 241 is connected to the switch SW and the other end is connected to the ground end.

The isolation circuit 260 includes an optical coupler 261 and a fourth resistor R4. The fourth resistor R4 is connected between the primary side of the optical coupler 261 and the ground end. Besides, a ninth resistor R9 is connected between the isolation circuit 260 and the switch SW.

The control circuit 270 receives the start signal output by the isolation circuit 260, and then transmits the DC power output by the first rectifier circuit 200 to the power module 250. The control circuit 270 includes a transistor 271 which is an IGBT. In another embodiment, the MOSFET, bipolar transistor etc. can also be adopted. The input end of the transistor 271 is connected to the isolation circuit 260, and the output end is connected to the power module 250. Besides, a tenth resistor R10 is connected to the switch SW.

The clamp circuit 280 can clamp the separate image signal at a predetermined voltage level, and includes a second capacitor C2 and a first diode D1. The second rectifier circuit 290 is connected to the clamp circuit 280, and includes a third capacitor C3 and a second diode D2. The P-type side of the first diode D1 is connected to the ground end, while the N-type side is connected to one end of the second capacitor C2. The P-type side of the second diode D2 is connected between the second capacitor C2 and the first diode D1, while the N-type side is connected to one end of the second capacitor C2.

Additionally, in order to protect the whole circuit, the output end of the first rectifier circuit 200 is connected to a fourth capacitor C4, for filtering noise. Furthermore, the output end of the first rectifier circuit 200 is connected to a fifth resistor R5 and a sixth resistor R6. The fifth resistor R5 and the sixth resistor R6 are connected to each other in series, and the other end of the sixth resistor R6 is connected to a fifth capacitor C5. In another embodiment, the fifth resistor R5 and the sixth resistor R6 are replaced by a single resistor after proper selection. A seventh resistor R7 and an eighth resistor R8 are connected between the output end of the first rectifier circuit 200 and the power module 250. In another embodiment, the seventh resistor R7 and the eighth resistor R8 are replaced by a single resistor after proper selection.

According to the embodiments of the invention, the IC system does not need to have the function of turning on and off the machine, so the power control circuit can suspend the action completely, thereby reducing the basic power consumption when the machine is turned off completely. Besides, through the mutual cooperation of the signal generating circuit and/or the separate image signal, no matter whether the system is switched from a complete power-off to a normal power-on, or from a normal operating mode to a standby mode in the power-on state, the power consumption of the system can be greatly reduced through controlling the power controller by the signal generating circuit as well as the isolation circuit due to the input of the separate image signal when the display device is completely turned off or in the standby state.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A power control circuit of a display device, the display device being provided with a power module, the power control circuit comprising:

a first signal generating circuit, for outputting a first signal;

a second signal generating circuit, connected to the first signal generating circuit, for outputting a second signal after receiving the first signal, wherein the second signal controls the on and off of the power module;

a driving circuit, connected to the second signal generating circuit, for outputting a DC power to start the power module after receiving the second signal;

an isolation circuit, for receiving a separate image signal and outputting a start signal; and a control circuit, connected to the isolation circuit, for outputting the DC power to start the power module after receiving the start signal.

2. The power control circuit according to claim 1, wherein the separate image signal is an H-SYNC.

3. The power control circuit according to claim 1, wherein the separate image signal is a V-SYNC.

4. The power control circuit according to claim 1, further comprising a voltage regulator circuit connected to the signal generating circuit to maintain the stability of the voltage level of the first signal.

5. The power control circuit according to claim 4, wherein the voltage regulator circuit comprises a zener diode.

6. The power control circuit according to claim 1, wherein the signal generating circuit comprises:

a switch;

a first resistor with one end connected to the switch and the other end connected to the ground;

a second resistor with one end connected to the switch; and a first capacitor, connected between the first resistor and the second resistor.

7. The power control circuit according to claim 1, wherein the second signal generating circuit comprises a flip-flop.

8. The power control circuit according to claim 1, wherein the driving circuit comprises:

a transistor; and a third resistor, connected to the transistor.

9. The power control circuit according to claim 1, wherein the isolation circuit comprises:

a optical coupler; and a first resistor, connected to the optical coupler.

10. The power control circuit according to claim 9, further comprising a ninth resistor connected between the isolation circuit and the first signal generating circuit.

11. The power control circuit according to claim 1, wherein the control circuit comprises a transistor.

12. The power control circuit according to claim 10, further comprising a tenth resistor connected between the control circuit and the first signal generating circuit.

13. The power control circuit according to claim 1, further comprising a first rectifier circuit, for receiving an AC power and rectifying the AC power into the DC power.

14. The power control circuit according to claim 13, further comprising a fourth capacitor connected between the first rectifier circuit and the ground end.

15. The power control circuit according to claim 13, further comprising a fifth resistor and a sixth resistor connected to each other in series and between the first rectifier circuit and the first signal generating circuit.

16. The power control circuit according to claim 15, further comprising a fifth capacitor connected between the sixth resistor and the ground end.

17. The power control circuit according to claim 13, further comprising a resistor connected between the first rectifier circuit and the first signal generating circuit.

18. The power control circuit according to claim 17, further comprising a fifth capacitor connected between the resistor and the ground end.

19. The power control circuit according to claim 13, further comprising a seventh resistor and an eighth resistor connected to each other in series and between the first rectifier circuit and the power module.

20. The power control circuit according to claim 1, further comprising a clamp circuit, for clamping the voltage of the separate image signal at a predetermined level, the clamp circuit comprising:

a second capacitor; and a first diode, connected to the first capacitor.

21. The power control circuit according to claim 20, further comprising a resistor connected between the first rectifier circuit and the first signal generating circuit.

22. The power control circuit according to claim 1, further comprising a second rectifier circuit, for rectifying the separate image signal clamped at a predetermined level, the second rectifier circuit comprising:

a second diode; and a third capacitor, connected to the second diode.

* * * * *